US011013298B2

(12) United States Patent
Baschak et al.

(10) Patent No.: US 11,013,298 B2
(45) Date of Patent: May 25, 2021

(54) RELEASABLE FASTENER

(71) Applicant: NIKE, Inc., Beaverton, OR (US)

(72) Inventors: Kimberly D. Baschak, Portland, OR (US); Kyle Schepke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/453,059

(22) Filed: Jun. 26, 2019

(65) Prior Publication Data

US 2020/0022466 A1 Jan. 23, 2020

Related U.S. Application Data

(60) Provisional application No. 62/700,310, filed on Jul. 18, 2018.

(51) Int. Cl.

| | |
|---|---|
| ***A44B 19/22*** | (2006.01) |
| ***A44B 19/28*** | (2006.01) |
| ***A44B 19/30*** | (2006.01) |

(52) U.S. Cl.

CPC ..... *A44B 19/22* (2013.01); *A44B 19/28* (2013.01); *A44B 19/30* (2013.01)

(58) Field of Classification Search

CPC ..... A44B 19/22; A44B 19/28; A44B 19/30; A44B 19/301; A44B 19/382; A45C 13/103

See application file for complete search history.

(56) References Cited

U.S. PATENT DOCUMENTS

| | | | | |
|---|---|---|---|---|
| 2,616,141 A | | 11/1952 | Morin | |
| 2,889,605 A | | 6/1959 | Morin | |
| 4,326,319 A | | 4/1982 | Friedberg | |
| 4,350,375 A | | 9/1982 | Bako | |
| 4,395,891 A | | 8/1983 | Remington | |
| 4,514,884 A | | 5/1985 | Kaneko | |
| 4,756,173 A | * | 7/1988 | Yang | A44B 19/301 70/68 |
| 5,608,952 A | | 3/1997 | Wilder | |
| 5,697,130 A | | 12/1997 | Smith | |
| 6,026,547 A | | 2/2000 | O'Donnell | |
| 6,308,541 B1 | * | 10/2001 | Stowe | A44B 19/301 70/312 |
| 6,510,593 B1 | | 1/2003 | Kim | |
| 6,604,262 B2 | | 8/2003 | Wang | |
| 7,073,233 B2 | | 7/2006 | Leva et al. | |

(Continued)

FOREIGN PATENT DOCUMENTS

| | | |
|---|---|---|
| EP | 2002744 A1 | 12/2008 |
| EP | 2517595 B1 | 12/2015 |

(Continued)

OTHER PUBLICATIONS

Nguyen, Tuan C., "Behold! The World's First One-Handed Zipper," smithsonianmag.com, Oct. 30, 2013. https://www.smithsonianmag.com/innovation/behold-the-worlds-first-one-handed-zipper-7278212/.

(Continued)

*Primary Examiner* — Robert Sandy

*Assistant Examiner* — David M Upchurch

(74) *Attorney, Agent, or Firm* — Shook Hardy & Bacon, LLP

(57) ABSTRACT

A slide fastener having multiple slider tracks and multiple slider bodies that converge at a central hub.

18 Claims, 3 Drawing Sheets

(56) References Cited

U.S. PATENT DOCUMENTS

| | | | | |
|---|---|---|---|---|
| 7,111,714 | B1 | 9/2006 | Bell, III | |
| D531,545 | S | 11/2006 | Yamazaki | |
| 7,404,240 | B2 | 7/2008 | Nedbal et al. | |
| 7,516,523 | B2 * | 4/2009 | Okot | A44B 19/262 24/382 |
| 8,146,214 | B2 | 4/2012 | Peters et al. | |
| 8,234,760 | B2 | 8/2012 | Vogelsang et al. | |
| 8,528,115 | B2 | 9/2013 | Damon et al. | |
| 8,714,605 | B1 | 5/2014 | Coratola et al. | |
| 9,027,210 | B2 | 5/2015 | Peters et al. | |
| 9,149,092 | B2 | 10/2015 | Damon et al. | |
| 9,545,158 | B2 | 1/2017 | Goldberg | |
| D779,373 | S | 2/2017 | Mayo | |
| 9,888,747 | B2 * | 2/2018 | Smith | A44B 19/30 |
| 9,902,529 | B2 * | 2/2018 | Reinders | A44B 19/305 |
| 10,687,589 | B2 * | 6/2020 | Goldberg | A47C 31/007 |
| 10,716,379 | B2 * | 7/2020 | Ponti | A44B 19/301 |
| 2008/0196217 | A1 | 8/2008 | Eschbach | |
| 2012/0042433 | A1 * | 2/2012 | Damon | A41F 1/00 2/69 |
| 2014/0060988 | A1 * | 3/2014 | Lai | A45C 5/00 190/101 |

FOREIGN PATENT DOCUMENTS

| | | | |
|---|---|---|---|
| GB | 2346653 | A | 8/2000 |
| GB | 2451302 | B | 10/2012 |

OTHER PUBLICATIONS

"Mens Zipper Pants for Arthritis, Catheters & Paralysis—2 Way Zippers & Easy Access Clothing," Silvert's, silverts.com, Item #41300. Jan. 11, 2018. https://web.archive.org/web/20180111082157/https://www.silverts.com/show.php/product/41300-mens-zipper-pants-for-arthritis-catheters-paralysis-2-way-zipperseasy-access-clothing.

International Search Report and Written Opinion dated Sep. 19, 2019 in International Patent Application No. PCT/US2019/040153, 15 pages.

International Preliminary Report on Patentability received for PCT Patent Application No. PCT/US2019/040153, dated Jan. 28, 2021, 9 pages.

* cited by examiner

RELEASABLE FASTENER

CROSS-REFERENCE TO RELATED APPLICATIONS

This application, assigned U.S. application Ser. No. 16/453,059, filed Jun. 26, 2019, and entitled "Releasable Fastener," claims the benefit of priority of U.S. Prov. App. No. 62/700,310, filed Jul. 18, 2018, and entitled "Releasable Fastener." The entirety of the aforementioned application is incorporated by reference herein.

TECHNICAL FIELD

This disclosure relates to a multi-slider releasable fastener.

BACKGROUND

Various types of releasable fasteners may be used to connect portions of an article together. One type includes a slider that traverses a pair of rails to connect the rails, and a zipper is an example of this type of releasable fastener. Some releasable fasteners may include multiple sliders that traverse outward from a common position in order to couple rails. Sometimes it may be challenging to align rails when a releasable connector includes multiple sliders and multiple pairs of rails. In addition, in some instances, slider pullers may be challenging to grip.

BRIEF DESCRIPTION OF THE DRAWINGS

Subject matter is described in detail in this Specification with reference to the below listed figures, which are incorporated herein by reference.

DETAILED DESCRIPTION

Subject matter is described throughout this Specification in detail and with specificity in order to meet statutory requirements. But the aspects described throughout this Specification are intended to be illustrative rather than restrictive, and the description itself is not intended necessarily to limit the scope of the disclosure or the claims. Rather, the disclosed and claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the disclosure and the claims.

At a high level, the disclosure describes a slide fastener for coupling a first textile to a second textile. For example, the slide fastener might couple a first portion of an upper body garment to a second portion of an upper body garment. An example upper body garment is a jacket, and the slide fastener described in this Specification might be used to provide a front closure for the jacket. In other aspects, the slide fastener might be used to provide a closure for other articles, such as a footwear article or a bag.

Figure 1:
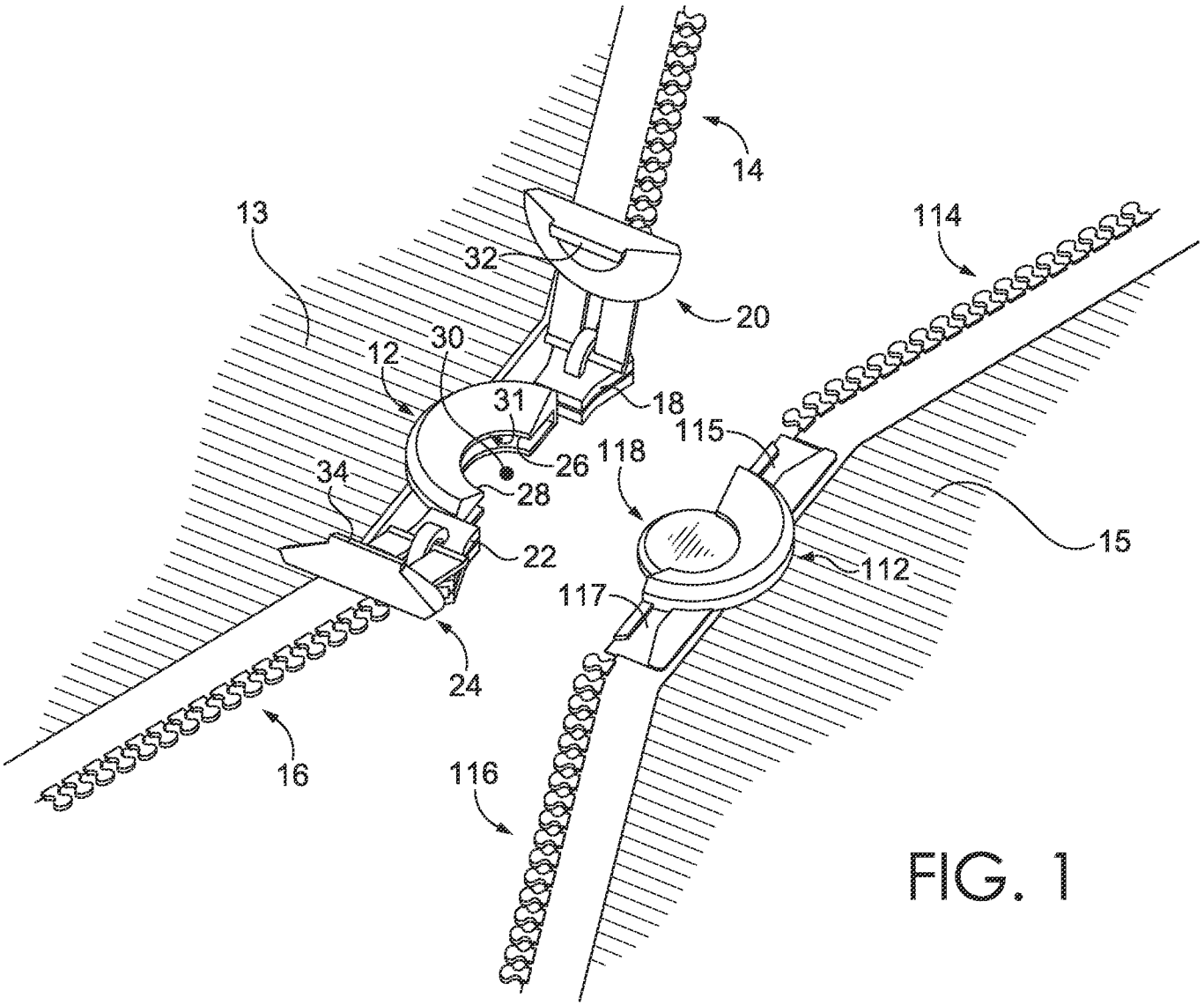
FIG. 1 depicts a slide fastener in accordance with an aspect of this disclosure.

Referring to FIG. 1, an example slide fastener includes a slider hub 12 coupled to a first textile 13. The first textile might also, or alternatively, include a textile strip, such as a zipper tape. The slide fastener includes a first slider track 14 and a second slider track 16 that are both coupled to the first textile 13 near the slider hub 12 and that both extend away from the slider hub 12 in a respective direction. In this illustrative example, the slider tracks 14 and 16 include zipper teeth, and in other aspects, the slider tracks 14 and 16 might include other structures that connect to a mating track using a slider. The slider tracks 14 and 16 might be positioned in various locations of an article. For example, if the slide fastener were coupled to a jacket, the first slider track 14 might extend towards the collar or neckline and the second slider track 16 might extend towards the waistline or bottom of the jacket. On a footwear article, the slide fastener might be coupled to the tongue or throat, and one slider track might extend towards a shoe collar, whereas the other slider track might extend towards a toe box or vamp. On a bag, the slide fastener might be positioned on a top of a bag (e.g., top of duffel back) and each slider track might extend towards a respective end of the bag.

Figure 2:
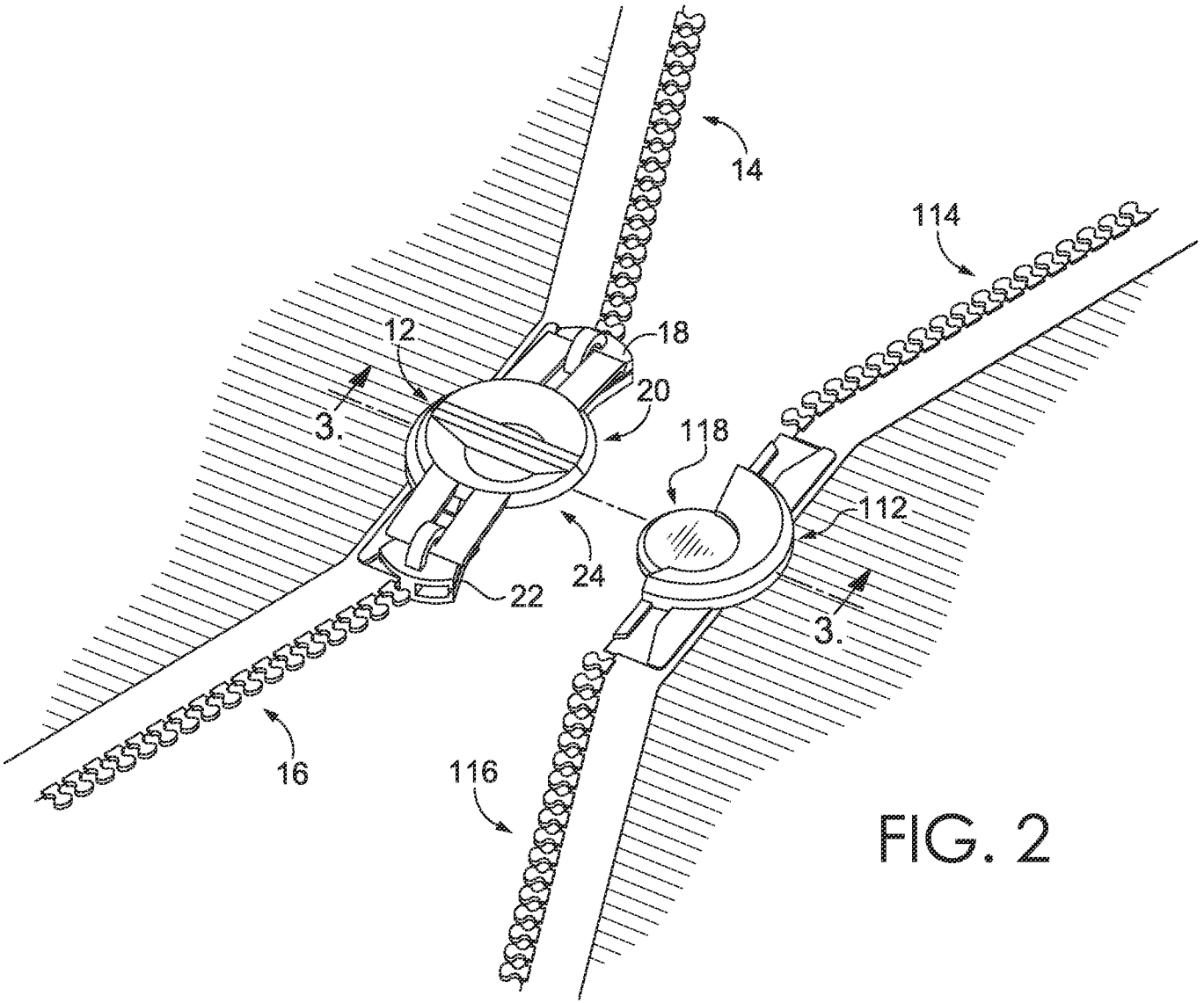
FIG. 2 depicts the slide fastener of FIG. 1 with the slider pullers in a stowed position.

In FIG. 1, the slide fastener also includes a first slider body 18 coupled to, and movable along, the first slider track 14. The first slider body 18 connects to another slider track 114, and when the first slider body 18 traverses the two slider tracks 14 and 114, the first slider body 18 interdigitates the teeth of the slider tracks 14 and 114. A first slider puller 20 is rotatably coupled to the first slider body 18, such that the first slider puller 20 rotates between a stowed position (FIG. 2) and a sliding position (FIG. 1). In the stowed position (FIG. 2) the first slider puller 20 is folded at least partially over top the slider hub 12.

In FIG. 1, the slide fastener also includes a second slider body 22 coupled to, and movable along, the second slider track 16. The second slider body 22 connects to another slider track 116, and when the second slider body 22 traverses the two slider tracks 16 and 116, the second slider body 22 interdigitates the teeth of the slider tracks 16 and 116. A second slider puller 24 is rotatably coupled to the second slider body 22, and the second slider puller 24 rotates between a stowed position (FIG. 2) and a sliding position (FIG. 1). In the stowed position (FIG. 2) the second slider puller 24 is folded at least partially over top the slider hub 12.

In order to connect the slider track 114 to the first slider body 18, the base 115 of the slider track 114 slips or slides into a slot on a side of the first slider body 18. The base 115 is similar to a pin of a traditional zipper, but the base 115 might have different sizes and shapes than that of a traditional zipper that permit the base 115 to slide through the slot. Similarly, in order to connect the slider track 116 to the second slider body 22, a base 117 of the slider track 116 slips or slides into a slot on a side of the second slider body 22. In accordance with an aspect of this disclosure, in order to help retain the slider bodies 18 and 22 in a position that aligns with the bases 115 and 117, in the stowed position (FIG. 2) of the first and second slider pullers 20 and 24, the first and second slider pullers 20 and 24 releasably engage with the slider hub 12, with each other, or a combination thereof. This engagement with the slider hub 12 and/or with each other temporarily retains the first slider body 18 and the second slider body 22 proximate to the slider hub 12. Accordingly, the first slider body 18 and the second slider body 22 are each alignable with slider tracks 114 and 116 on the second textile 15 when the first and second slider pullers 20 and 24 are in stowed positions (FIG. 2) and the first and second slider bodies 18 and 22 are retained proximate to the slider hub 12.

The slider pullers 20 and 24 might engage the slider hub 12 in various manners. For example, the slider hub 12 includes a first slider-puller retaining lip 26 and a second slider-puller retaining lip 28. As such, the slider pullers 20 and 24 might include a respective hook that catches on the respective lip 26 and 28 when each slider puller is rotated to a position extending over the slider hub 12. In this aspect, the slider pullers 20 and 24 may, or may not, engage each other. In a further aspect, the first and second slider-puller retaining lips 26 and 28 include a perimeter edge 31 circumscribing a central recess 30. As such, in accordance with the illustrative example provided by FIGS. 1-4, the first slider puller 20 includes a first stud 32; the second slider puller 24 includes a second stud 34; and in the stowed positions (FIG. 2), the first and second studs 32 and 34 insert into the central recess 30 and frictionally engage the perimeter edge 31. In a further aspect, in the stowed position of FIG. 2, the first and second studs 32 and 34 may frictionally engage each other to help bias the first and second slider pullers 20 and 24 in the stowed position.

In an alternative aspect, the first and second slider pullers 20 and 24 may each be folded over the top of the slider hub 12 and towards each other, and each of the slider pullers 20 and 24 may engage, or be hooked onto, each other, without engaging the slider hub 12. In this aspect, the frictional engagement of the slider pullers 20 and 24 with each other may retain the slider bodies 18 and 22 in the aligned position to connect with the other tracks 114 and 116.

Figure 4:
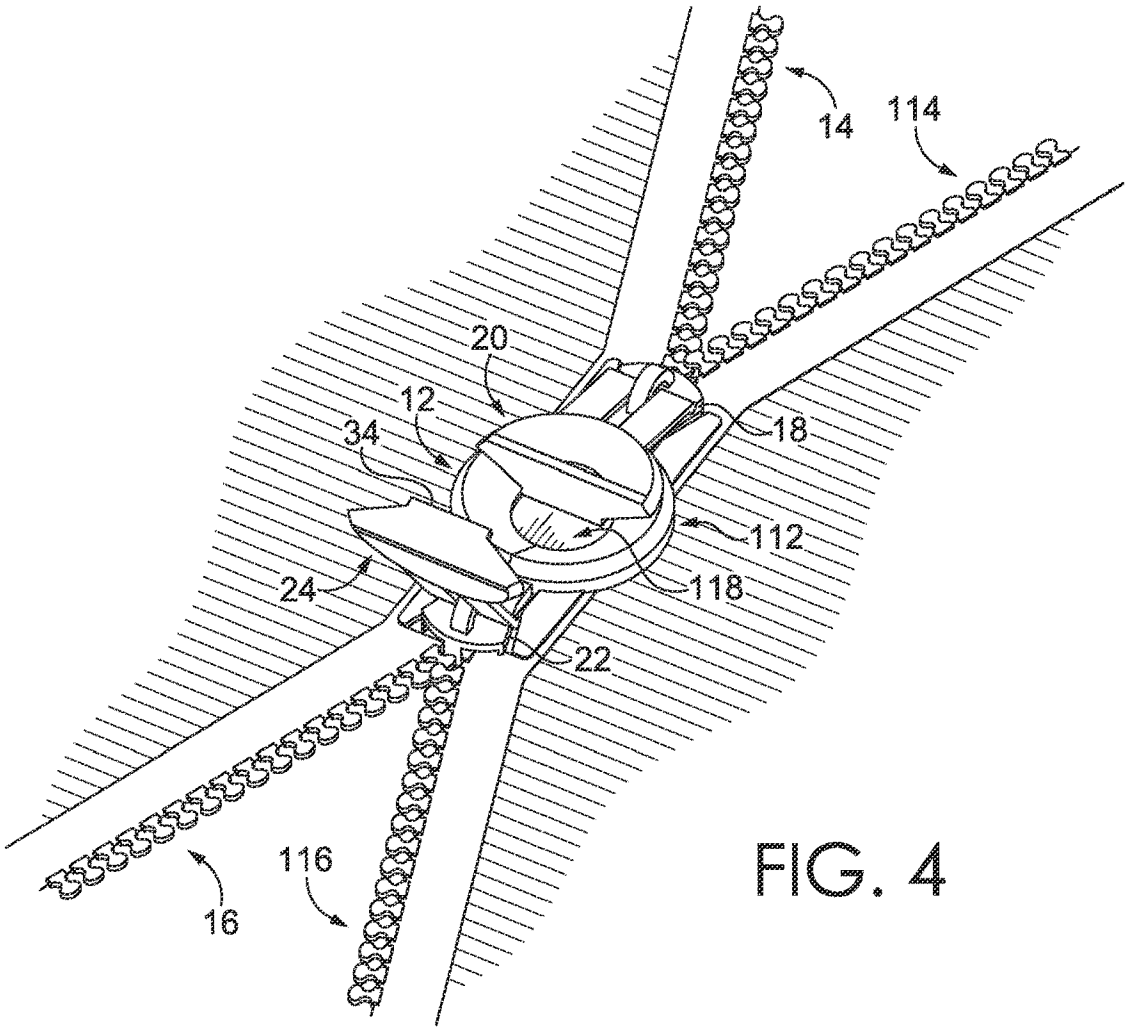
FIG. 4 depicts the slide fastener of FIG. 1 in which the snap connector has been engaged with the slider hub.
Figure 3:
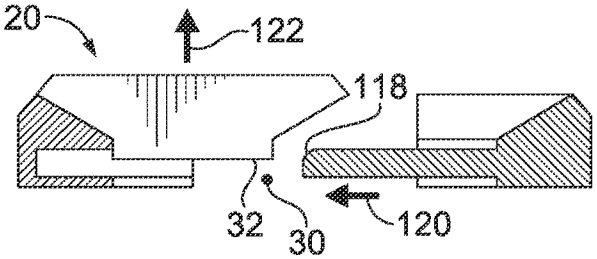
FIG. 3 depicts a view taken along the reference line 3-3 identified in FIG. 2.

The slider tracks 114 and 116 on the second textile 15 are separated by a snap connector 112 that releasably connects to the slider hub 12. In accordance with an aspect of the disclosure, the snap connector 112 actively disengages the first and second slider pullers 20 and 24 from the stowed positions (FIG. 2) when the snap connector 112 releasably connects to the slider hub 12. For example, FIG. 3 depicts the slider puller 20 with the stud 32 in a stowed position (e.g., folded into the central recess 30). When the snap connector 112 is moved in the direction of the arrow 120, a camming surface 118 of the snap connector 112 engages the stud 32, and forces the slider puller 20 to rotate in the direction of the arrow 122 and out of the central recess 30. A similar action is effected on the slider puller 24, and as depicted in FIG. 4, the slider puller 24 has been dislodged from the central recess 30 by the snapping of the snap connector 112 into position with the slider hub 12. This engagement of the snap connector 112 and the slider hub 12 has also slid the bases 115 and 117 of the slider tracks 114 and 116 into the slider bodies 18 and 22, respectively. As such, the slide fastener is aligned, engaged, and ready to be operated, such as by pulling on the slider puller 24. Among other functions, this operation of the slide fastener may make it easier to utilize the slide fastener by users with more limited dexterity or users wearing gloves.

The releasable fastener described in this Specification may be used in various articles. For example, the releasable fastener may be used to connect to portions of a garment, footwear, or bag. In addition, the releasable fastener may be used on various other articles that might typically utilized a zipper.

From the foregoing, it will be seen that this subject matter adapted to attain the ends and objects described in this Specification, as well as other advantages which are obvious and which are inherent to the structure. It will be understood that certain features and subcombinations are of utility and may be employed without reference to other features and subcombinations. This is contemplated by and is within the scope of the claims. Since many possible variations and alternatives may be made of this subject matter without departing from the scope thereof, it is to be understood that all matter herein set forth or shown in the accompanying drawings is to be interpreted as illustrative and not in a limiting sense.

The invention claimed is:

1. A slide fastener comprising:

a slider hub coupled to a first textile;

a first slider track and a second slider track that are both coupled to the first textile near the slider hub and that both extend away from the slider hub in a respective direction;

a first slider body coupled to, and movable along, the first slider track;

a first slider puller rotatably coupled to the first slider body, wherein the first slider puller rotates between a stowed position and a sliding position, and wherein in the stowed position the first slider puller is folded at least partially over top of the slider hub;

a second slider body coupled to, and movable along, the second slider track; and a second slider puller rotatably coupled to the second slider body, wherein the second slider puller rotates between a stowed position and a sliding position, wherein in the stowed position the second slider puller is folded at least partially over top of the slider hub;

wherein, in the stowed position of the first slider puller and the second slider puller, the first slider puller and the second slider puller releasably engage with the slider hub, with each other, or a combination thereof, in order to temporarily retain the first slider body and the second slider body proximate to the slider hub;

wherein the first slider body and the second slider body are each alignable with slider tracks on a second textile when the first slider puller and the second slider puller are in the stowed position and the first slider body and the second slider body are retained proximate to the slider hub; and wherein the slider tracks on the second textile are divided into a third slider track and a fourth slider track by a snap connector that releasably connects to the slider hub.

2. The slide fastener of claim 1, wherein the slider hub includes a first slider-puller retaining lip and a second slider-puller retaining lip.

3. The slide fastener of claim 2, wherein each of the first slider-puller retaining lip and the second slider-puller retaining lip includes a perimeter edge circumscribing a central recess.

4. The slide fastener of claim 3, wherein the first slider puller includes a first stud and the second slider puller includes a second stud, and wherein, in the stowed position, the first stud and the second stud insert into the central recess and frictionally engage the perimeter edge.

5. The slide fastener of claim 4, wherein the snap connector actively disengages the first slider puller and the second slider puller from the stowed position when the snap connector releasably connects to the slider hub.

6. The slide fastener of claim 5, wherein the snap connector includes a camming surface that engages the first stud and the second stud to disengage the first slider puller and the second slider puller from the stowed position.

7. The slide fastener of claim 4, wherein, in the stowed position, the first stud and the second stud frictionally engage each other.

8. The slide fastener of claim 1, wherein, in the stowed position, the first slider puller and the second slider puller are each folded over top the slider hub and frictionally engage each other.

9. A slide fastener comprising:

a slider hub coupled to a first textile having a first slider track extending away from a first side of the slider hub and a second slider track extending away from an opposite second side of the slider hub;

a first slider body coupled to the first slider track, the first slider body having a first slider puller rotatably coupled thereto, wherein the first slider puller is rotatable between a stowed position and a sliding position; and a second slider body coupled to the second slider track, the second slider body having a second slider puller rotatably coupled thereto, wherein the second slider puller is rotatable between a stowed position and a sliding position, wherein, in the stowed position, the first slider puller and the second slider puller releasably engage with the slider hub, with each other, or a combination thereof, in order to temporarily retain the first slider body and the second slider body proximate to the slider hub, wherein, when the first slider puller and the second slider puller are in the stowed position, each of the first slider puller and the second slider puller are folded at least partially over a top of the slider hub.

10. The slide fastener of claim 9, further comprising, a snap connector coupled to a second textile having a third slider track extending away from a first side of the snap connector and a fourth slider track extending away from an opposite second side of the snap connector, wherein the snap connect or releasably connects to the slider hub.

11. The slide fastener of claim 10, wherein the snap connector actively disengages the first slider puller and the second slider puller from the stowed position when the snap connector releasably connects to the slider hub.

12. The slide fastener of claim 10, wherein the first slider body and the second slider body are respectively alignable with the third slider track and the fourth slider track when the first slider puller and the second slider puller are in the stowed position and the first slider body and the second slider body are retained proximate to the slider hub.

13. The slide fastener of claim 9, wherein the slider hub includes a first slider-puller retaining lip and a second slider-puller retaining lip that together include a perimeter edge circumscribing a central recess.

14. The slide fastener of claim 13, wherein the first slider puller includes a first stud and the second slider puller includes a second stud.

15. The slide fastener of claim 14, wherein, in the stowed position, the first stud and the second stud insert into the central recess and frictionally engage the perimeter edge.

16. The slide fastener of claim 14, wherein, in the stowed position, the first stud and the second stud frictionally engage each other.

17. A slide fastener comprising:

a slider hub coupled to a first textile having a first slider track extending away from a first side of the slider hub and a second slider track extending away from an opposite second side of the slider hub;

a first slider body coupled to the first slider track, the first slider body having a first slider puller rotatably coupled thereto, wherein the first slider puller is rotatable between a stowed position and a sliding position;

a second slider body coupled to the second slider track, the second slider body having a second slider puller rotatably coupled thereto, wherein the second slider puller is rotatable between a stowed position and a sliding position, wherein, in the stowed position, the first slider puller and the second slider puller releasably engage with the slider hub, with each other, or a combination thereof; and a snap connector coupled to a second textile having a third slider track extending away from a first side of the snap connector and a fourth slider track extending away from an opposite second side of the snap connector, wherein the snap connector releasably connects to the slider hub, and wherein the snap connector actively disengages the first slider puller and the second slider puller from the stowed position when the snap connector releasably connects to the slider hub.

18. The slide fastener of claim 17, wherein when the first slider puller and the second slider puller are in the stowed position, each of the first slider puller and the second slider puller are folded at least partially over a top of the slider hub.

* * * * *